US010349496B2

(12) United States Patent
Wang et al.

(10) Patent No.: US 10,349,496 B2
(45) Date of Patent: Jul. 9, 2019

(54) LIGHTING CONTROL SYSTEM AND LIGHTING CONTROL DEVICE USED THEREFOR

(71) Applicant: PANASONIC INTELLECTUAL PROPERTY MANAGEMENT CO., LTD., Osaka (JP)

(72) Inventors: Yanfeng Wang, Osaka (JP); Yoshihisa Homma, Osaka (JP); Kiyotaka Takehara, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/754,245

(22) PCT Filed: Jul. 26, 2016

(86) PCT No.: PCT/JP2016/003456
§ 371 (c)(1),
(2) Date: Feb. 21, 2018

(87) PCT Pub. No.: WO2017/033397
PCT Pub. Date: Mar. 2, 2017

(65) Prior Publication Data

US 2018/0242434 A1 Aug. 23, 2018

(30) Foreign Application Priority Data

Aug. 21, 2015 (JP) ..... 2015-163818

(51) Int. Cl.
*H05B 37/02* (2006.01)
*H05B 33/08* (2006.01)

(52) U.S. Cl.
CPC ..... *H05B 37/0272* (2013.01); *H05B 33/0845* (2013.01); *H05B 33/0857* (2013.01);
(Continued)

(58) Field of Classification Search
CPC ..... H05B 37/0272; H05B 37/0227; H05B 37/0218; H05B 33/0845; H05B 33/0842;
(Continued)

(56) References Cited

U.S. PATENT DOCUMENTS 8,913,885 B2 * 12/2014 Iizuka ..... H04B 10/116 396/56
9,088,360 B2 * 7/2015 Oshima ..... H04B 10/1143
(Continued)

FOREIGN PATENT DOCUMENTS

JP 2003-157984 A 5/2003
JP 2008-181874 A 8/2008
(Continued)

OTHER PUBLICATIONS

International Search Report and Written Opinion issued in International Patent Application No. PCT/JP2016/003456, dated Oct. 25, 2016; with partial English translation.

*Primary Examiner* — Vibol Tan
(74) *Attorney, Agent, or Firm* — McDermott Will & Emery LLP

(57) ABSTRACT

A lighting control system which enables illumination control based on the location of a person present in a predetermined area, and a lighting control device for the lighting control system. In the lighting control system and the lighting control device according to the present invention, a lighting control system includes a plurality of light sources installed in a control area, at least one radio wave transmission device, a portable terminal configured to receive a radio wave signal emitted from the at least one radio wave transmission device, and a lighting control device configured to select a target light source serving as a light source of a control object from a plurality of light source based on an intensity of the radio wave signal received by the portable
(Continued)

terminal from the radio wave transmission device and to control a lighting state of the target light source.

5 Claims, 7 Drawing Sheets

(52) U.S. Cl.
CPC ..... *H05B 33/0863* (2013.01); *H05B 37/02* (2013.01); *H05B 37/0227* (2013.01)

(58) Field of Classification Search
CPC ..... H05B 37/0245; H05B 37/029; H05B 33/0857; H05B 33/0863; H05B 33/0806; H05B 33/0854; H05B 33/086; G06F 3/04817; H04B 10/50; H04B 1/3827; H04B 1/3833
See application file for complete search history.

(56) References Cited

U.S. PATENT DOCUMENTS 9,137,877 B2 * 9/2015 Kim ..... H05B 37/0227
9,232,601 B2 * 1/2016 Fushimi ..... H05B 37/0245
9,600,983 B1 * 3/2017 Lydecker ..... G08B 5/36
9,629,217 B2 * 4/2017 Kim ..... H05B 37/0227
9,784,817 B2 * 10/2017 Lydecker ..... G01S 5/16
9,942,966 B2 * 4/2018 Nolan ..... H05B 37/0227
9,964,630 B2 * 5/2018 Lydecker ..... H04B 10/116
10,039,172 B2 * 7/2018 Nolan ..... G08C 17/02
2009/0297156 A1 * 12/2009 Nakagawa ..... G09F 9/33 398/130
2009/0310976 A1 * 12/2009 Nakagawa ..... G09F 9/33 398/183
2014/0246991 A1 * 9/2014 Kim ..... H05B 37/0227 315/292
2015/0147067 A1 * 5/2015 Ryan ..... H04B 10/116 398/118
2016/0345414 A1 * 11/2016 Nolan ..... G08C 17/02
2017/0148310 A1 * 5/2017 De Bruijn ..... G08C 23/04

FOREIGN PATENT DOCUMENTS

JP 2009-087834 A 4/2009
JP 2010-510621 A 4/2010
JP 2013-089392 A 5/2013
JP 2014-003481 A 1/2014
JP 2014-053294 A 3/2014
JP 2014-060078 A 4/2014
JP 2014-099857 A 5/2014
JP 2015-501630 A 1/2015
WO 2008/059412 A1 5/2008
WO 2013/067569 A1 5/2013

* cited by examiner

LIGHTING CONTROL SYSTEM AND LIGHTING CONTROL DEVICE USED THEREFOR

RELATED APPLICATIONS

This application is the U.S. National Phase under 35 U.S.C. § 371 of International Patent Application No. PCT/JP2016/003456, filed on Jul. 26, 2016, which in turn claims the benefit of Japanese Application No. 2015-163818, filed on Aug. 21, 2015, the entire disclosures of which Applications are incorporated by reference herein.

TECHNICAL FIELD

The present invention generally relates to lighting control systems and lighting control devices used for the lighting control systems.

BACKGROUND ART

There is a known technique in which street lamps which illuminates streets are controlled on the basis of the presence or absence of a passer-by (for example, see Patent Literature 1). Specifically, when no passer-by is present in a communication-enabled area of a street lamp, the street lamp provides illumination at a low illuminance. On the other hand, when a passer-by is present in the communication-enabled area of the street lamp, the street lamp receives a signal from a mobile phone carried by the passer-by, and the street lamp which has received the signal provides illumination at a high illuminance.

The technique of Patent Literature 1 enables illumination control of the street lamp only on the basis of the presence or absence of a passer-by in the communication enabled area. However, the technique of Patent Literature 1 does not enable illumination control based on the location of a passer-by present in the communication-enabled area.

Thus, there is a demand for a system which enables illumination control based on the location of a person present in a predetermined, communication-enabled area.

CITATION LIST

Patent Literature

Patent Literature 1: JP 2003-157984 A

SUMMARY OF INVENTION

One of the objectives of the present disclosure is to provide a lighting control system which enables illumination control based on the location of a person present in a predetermined area, and a lighting control device for the lighting control system.

A lighting control system according to an aspect of the present invention includes a plurality of light sources, at least one radio wave transmission device, a portable terminal, and a lighting control device. The plurality of light sources are installed in a predetermined area. The at least one radio wave transmission device is configured to emit a radio wave signal in the predetermined area. The portable terminal is configured to receive the radio wave signal emitted from the at least one radio wave transmission device and is portable by a user. The lighting control device is configured to select, based on an intensity of the radio wave signal received by the portable terminal from the at least one radio wave transmission device, a target light source serving as a light source of a control object from the plurality of light sources. The lighting control device is configured to control a lighting state of the target light source.

A lighting control device according to an aspect of the present invention is a lighting control device for a lighting control system. The lighting control system includes a plurality of light sources installed in a predetermined area, at least one radio wave transmission device configured to emit a radio wave signal in the predetermined area, and a portable terminal configured to receive the radio wave signal emitted from the at least one radio wave transmission device. The portable terminal is portable by a user. The lighting control device includes a communication section and a lighting command section. The communication section is configured to communicate with the portable terminal. The lighting command section is configured to select a target light source serving as a light source of a control object from the plurality of light sources based on an intensity of the radio wave signal received by the portable terminal from the at least one radio wave transmission device. The lighting command section is configured to control a lighting state of the target light source.

DESCRIPTION OF EMBODIMENTS

Embodiments will be described below with reference to the drawings.

Note that the following embodiments generally relate to lighting control systems and lighting control devices used for the lighting control systems. Moreover, the following embodiments specifically relate to a lighting control system configured to control a plurality of lighting fixtures installed in a predetermined area and a lighting control device used for the lighting control system.

First Embodiment

Figure 1:
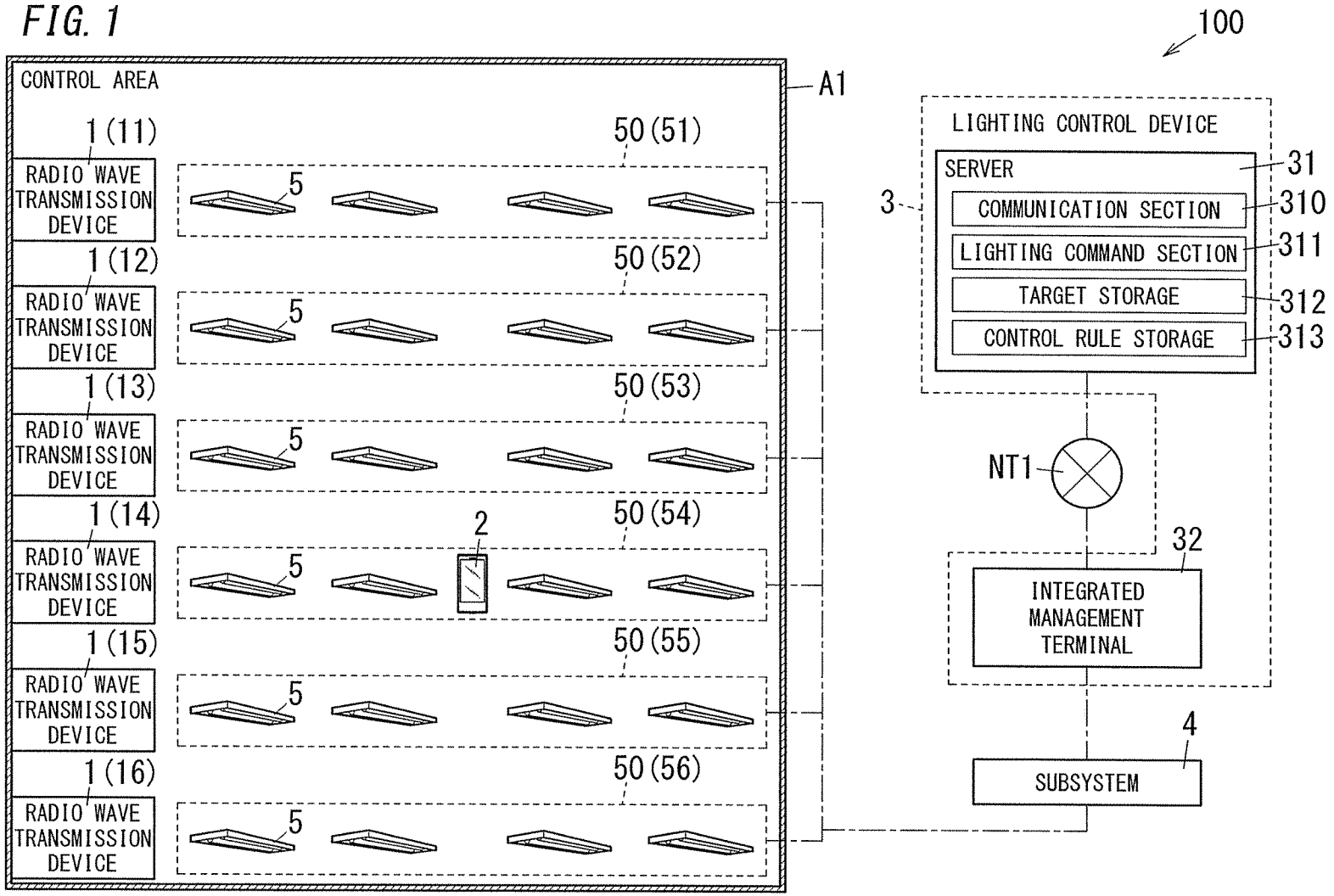
FIG. 1 is a block diagram illustrating a configuration of a system of a first embodiment.
Figure 2:
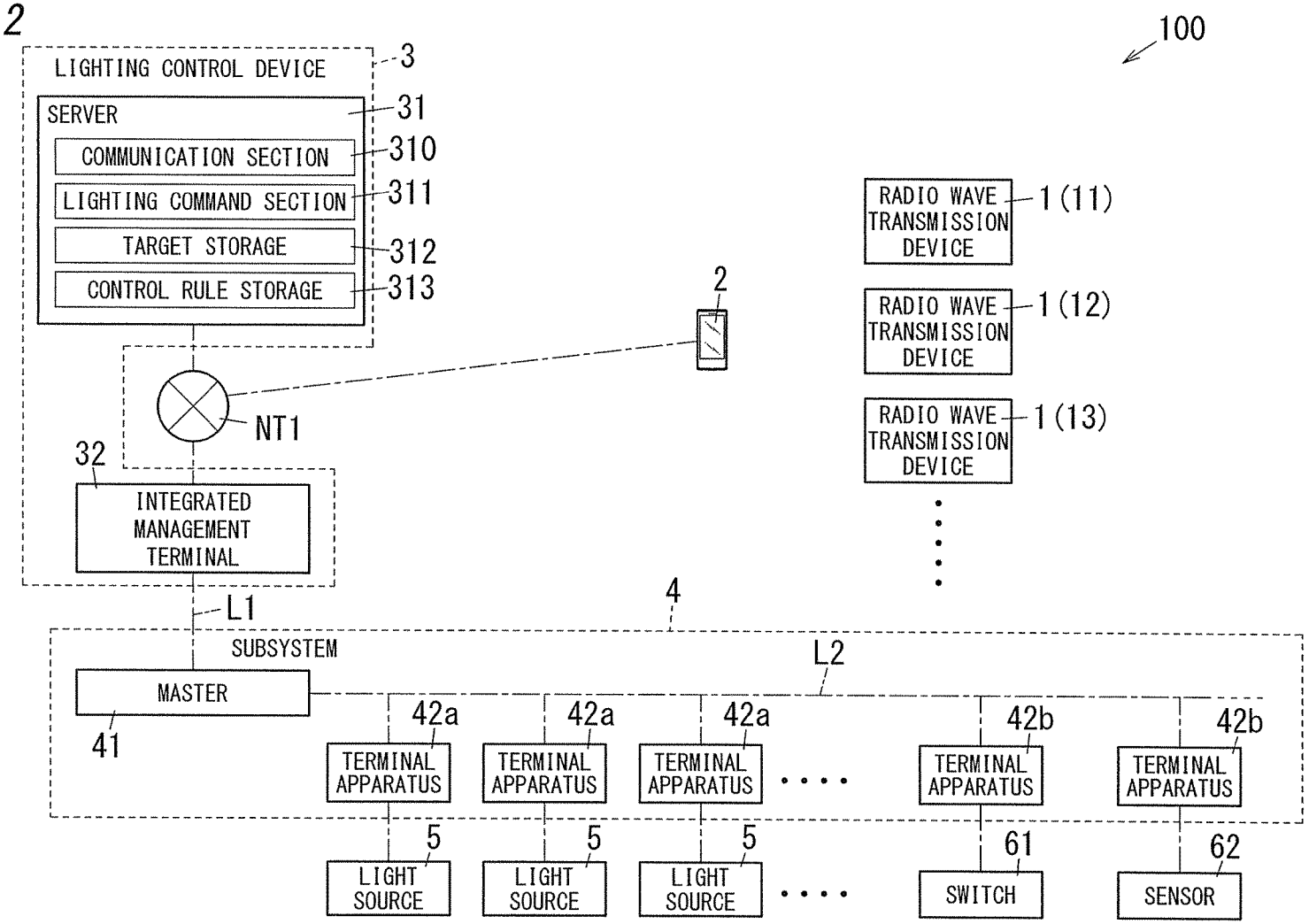
FIG. 2 is a block diagram illustrating a configuration of a subsystem of the first embodiment.

A control area of a lighting control system 100 of a first embodiment is each of floors in a facility such as a building, a factory, a warehouse, a shop, or an office. In the configuration in FIG. 1, a control area A1 in a building is shown as an example of the control area. Moreover, FIG. 2 shows a block configuration including a configuration of a subsystem 4. Note that in the present embodiment, a user of the lighting control system 100 is, for example, a worker or an employee in a factory, a warehouse, an office, or a customer in a shop, but the user is not limited to these examples.

The lighting control system 100 includes radio wave transmission devices 1, a portable terminal 2, a lighting control device 3, and the subsystem 4 as main components and controls lighting states of light sources 5.

In the control area A1, the plurality of light sources 5 are installed on a ceiling in the control area A1 to illuminate the control area A1. The control area A1 is in a shape of a rectangular parallelepiped. The plurality of light sources 5 are aligned and arranged in the upward and downward direction (vertical direction) and the right and left direction (horizontal direction) in the control area A1 in FIG. 1. Each light source 5 includes a light emitter such as an LED and a lighting apparatus for supplying lighting electric power to the light emitter. The lighting apparatus has a function of dimming and adjusting the color of light of the light emitter in accordance with an externally provided instruction.

The plurality of radio wave transmission devices 1 are installed in the control area A1. The radio wave transmission devices 1 regularly transmit, in the control area A1, radio wave signals including pieces of identification information. Each of the pieces of identification information is allocated specifically to a corresponding one of the radio wave transmission devices 1 and is, for example, a universally unique identifier (UUID) of 16 byte. That is, each of the radio wave transmission devices 1 regularly transmits the radio wave signal including the identification information of the radio wave transmission device 1. Wireless communication by which each of the radio wave transmission device 1 emits the radio wave signal is near field wireless communication such as Bluetooth (registered trademark) or Bluetooth Low Energy (BLE) (note that Bluetooth is a registered trademark), but the wireless communication is not limited to a specific communication scheme. Note that when the plurality of radio wave transmission devices 1 are distinguished from one another, the radio wave transmission devices are denoted by 11, 12, 13, . . . .

The portable terminal 2 is a smartphone, a tablet terminal, a mobile phone, or the like. The portable terminal 2 is portable by a person and is mobile in the control area A1. In the portable terminal 2, an illumination control application is installed. The portable terminal 2 is configured to execute the application to receive the radio wave signals from the radio wave transmission devices 1. The portable terminal 2 is configured to be connected to an external wide-area communication network NT1 such as the Internet via an access point or a mobile communication network to communicate with the lighting control device 3 on the wide-area communication network NT1.

The lighting control device 3 includes a server 31 and an integrated management terminal 32.

The server 31 includes a communication section 310, a lighting command section 311, target storage 312, and control rule storage 313. The communication section 310 is configured to communicate with the portable terminal 2 and the integrated management terminal 32 via the wide-area communication network NT1. Note that the server 31 may include one server computer or a cloud computing system.

The integrated management terminal 32 is provided to each of buildings and is configured to be connected to the wide-area communication network NT1 to communicate with the server 31 on the wide-area communication network NT1. Moreover, floors of each building are provided with the subsystems 4 on a one-to-one basis. Each of the subsystems 4 is connected to the integrated management terminal 32 via a communication line L1. Note that FIG. 1 shows only the control area A1 of one of a plurality of floors in a building.

As illustrated in FIG. 2, the subsystem 4 includes terminal apparatuses 42*a* to each of which the light source 5 is connected, terminal apparatuses 42*b* to each of which a switch 61 or a sensor 62 is connected, and a master 41 configured to perform illumination control through the terminal apparatuses 42*a* and 42*b*. Each terminal apparatus 42*b* receives from the switch 61 or the sensor 62 information for changing the lighting state of one or more light sources 5 serving as control objects. Each terminal apparatus 42*a* to which the light source 5 is connected has a configuration of controlling turning on and off of the light source 5 or a configuration of controlling at least one of dimming and adjusting the color of light of the light source 5. Examples of the sensor 62 includes a brightness sensor for monitoring ambient brightness, a motion sensor for monitoring the presence or absence of a person in a prescribed space area, and a temperature sensor for monitoring ambient temperature.

Note that the terminal apparatus 42*a* may be integrated with the lightsource 5, and the terminal apparatus 42*b* may be integrated with the switch 61 or the sensor 62.

Moreover, along with the subsystem 4, wiring and the like for supplying electric power to the light sources 5 are constructed.

The terminal apparatuses 42*a* and 42*b* are connected to the master 41 via a communication line L2 to communicate with the master 41. The master 41 is configured to acquire pieces of information which the terminal apparatuses 42*b* have received and to give instructions to the terminal apparatuses 42*a* to control the lighting states of the light sources 5 in accordance with the acquired pieces of information.

The terminal apparatuses 42*a* turn on, turn off, dim, and adjust the color of light of the light sources 5 in accordance with the instructions from the master 41. Specifically, the terminal apparatuses 42*a* are configured to turn on or off relays to turn on or off the light sources 5. The relays are each disposed on a power supply path to a corresponding one of the light sources 5. The terminal apparatuses 42*a* are configured to transmit dimming signals to the light sources 5 to dim the light sources 5. The terminal apparatuses 42*a* are configured to transmit color-adjusting signals to the light sources 5 to adjust the color of the light of the light sources 5.

In the subsystem 4, the master 41 stores the relationships between the switch 61 or the sensor 62 and each of the light sources 5. That is, the master 41 manages correspondence relationships between the switch 61 or the sensor 62 and each of the light sources 5 and manages contents of the instructions to be given to the light sources 5 in response to the information acquired from the switch 61 or the sensor 62. The master 41 stores, for example, a relationship indicating manipulation of which switch 61 turning on and off of the light source 5 are to be associated. The master 41 also stores a relationship between a state which the sensor 62 detects and a change to be made to the lighting state of the light source 5.

When the subsystem 4 includes a plurality of switches 61, identification information is provided to each of the plurality of switches 61 to distinguish the plurality of switches 61 from each other. When the subsystem 4 includes a plurality of sensors 62, identification information is provided to each of the plurality of sensors 62 to distinguish the plurality of sensors 62 from each other. In the subsystem 4, identification information is provided to each of the plurality of light sources 5 to distinguish the plurality of light sources 5 from each other. Based on these pieces of identification information, the master 41 manages the correspondence relationships between the switch 61 or the sensor 62 and each of the light sources 5. That is, in the master 41, it is possible not only to associate the switch 61 or the sensor 62 with the light source 5 on a one-to-one basis but also to associate one of the switch 61 and the sensor 62 to the plurality of light sources 5. In this case, it is possible to collectively control the plurality of light sources 5 by one of the switch 61 and the sensor 62. Such control is referred to as collective control. For example, in the master 41, setting control data for associating the pieces of identification information of the plurality of light sources 5 with the identification information of one switch 61 enables the one switch 61 to collectively change the lighting states of the plurality of light sources 5. The collective control includes group control and pattern control.

The group control is realized by, for example, setting control data in the master 41 such that the identification information of one switch 61 is associated with the pieces of identification information of the plurality of light sources 5. That is, in the group control, when the one switch 61 is manipulated, the plurality of light sources 5 associated with the one switch 61 based on the control data are collectively controlled so as to be in an identical lighting state. Thus, in the group control, manipulation of the one switch 61 enables the plurality of light sources 5 to be collectively turned on, and the manipulation of the one switch 61 enables the plurality of light sources 5 to be collectively turned off.

The pattern control is realized by, for example, setting control data in the master 41 such that the identification information of the one switch 61 is associated with the pieces of identification information and with respective lighting states of the plurality of light sources 5. That is, in the pattern control, when the one switch 61 is manipulated, the plurality of light sources 5 associated with the one switch 61 based on the control data are collectively controlled so as to be in the respective lighting states based on the control data. Thus, in the pattern control, manipulation of the one switch 61 enables the plurality of light sources 5 to be controlled to different dimming levels and different light colors.

Note that in the description of the group control and the pattern control, the switch 61 may be replaced with the sensor 62. The technique of the subsystem 4 configured to perform such remote monitoring control is known, and the configuration of the subsystem 4 is not an important point, and therefore, the detailed description thereof will be omitted.

The master 41 is connected to the integrated management terminal 32 via the communication line L1. The integrated management terminal 32 is configured to be connected to the external wide-area communication network NT1 such as the Internet via a router or the like to communicate with the server 31 on the wide-area communication network NT1. The master 41 further has a function of controlling the light sources 5 in the control area A1 by a signal from the lighting control device 3 (the integrated management terminal 32).

Figure 3:
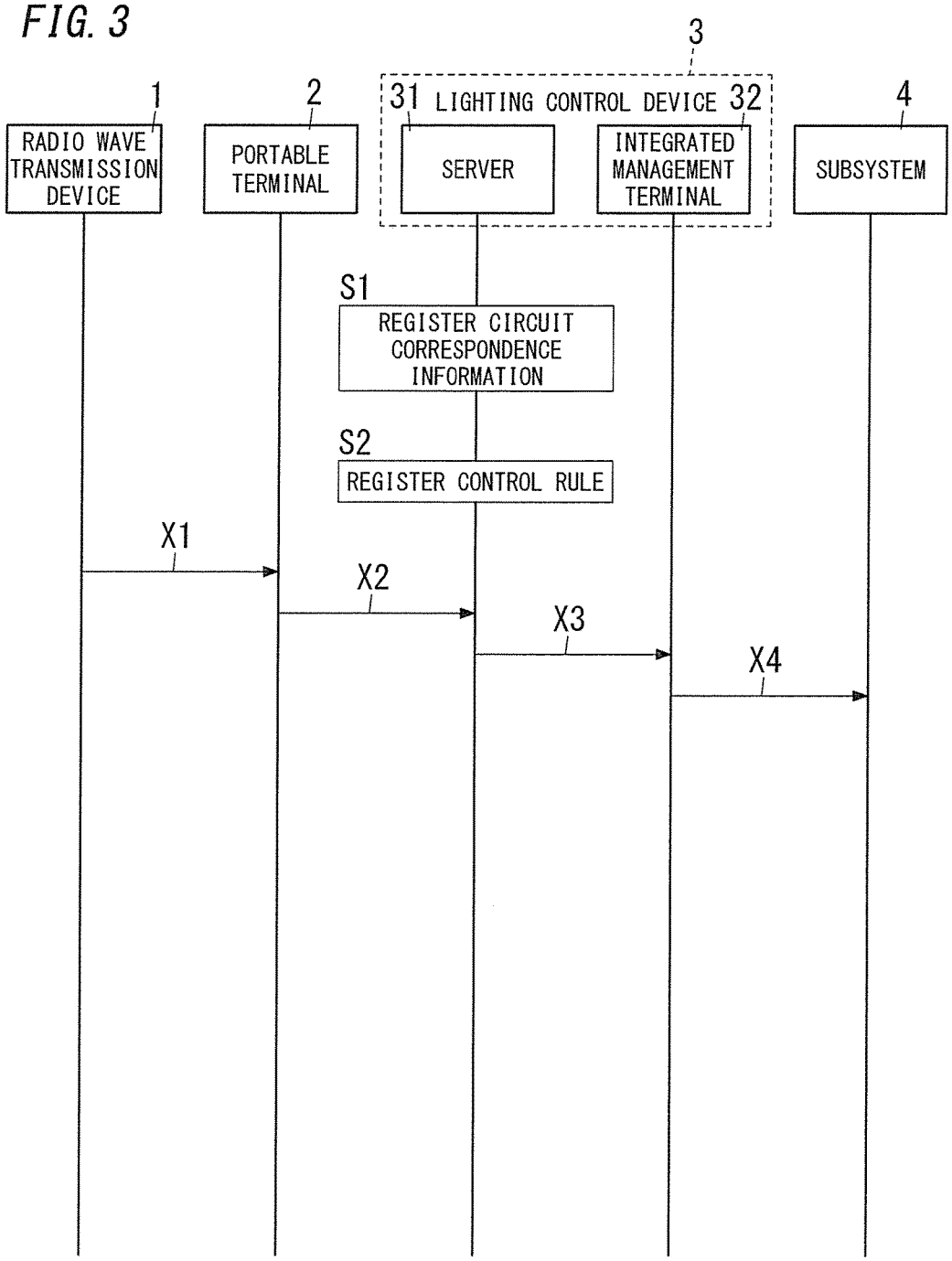
FIG. 3 is a sequence diagram illustrating operation of the first embodiment.

Operation of the lighting control system 100 of the present embodiment will be described below with reference to the sequence of FIG. 3.

In FIG. 1, the plurality of light sources 5 are aligned and arranged in the vertical direction and the horizontal direction in the control area A1. A plurality of light sources 5 aligned in a row in the horizontal direction in the control area A1 form a light source group 50. In FIG. 1, six light source groups 50 are formed in the control area A1. When the six light source groups 50 are distinguished from one another, the light source groups are hereinafter denoted by reference numbers 51 to 56. On one side of a set of the light source groups 51 to 56, radio wave transmission devices 11 to 16 respectively corresponding to the light source groups 51 to 56 are disposed. Each of the radio wave transmission devices 11 to 16 regularly transmits a radio wave signal in the control area A1. Each radio wave signal includes identification information specific to a corresponding one of the radio wave transmission devices 11 to 16.

In preparation, each of the light source groups 51 to 56 is associated with the identification information of a corresponding one of the radio wave transmission devices 11 to 16. In the target storage 312 of the server 31, correspondence relationships (circuit correspondence information) between the identification information of each of the radio wave transmission devices 11 to 16 and a corresponding one of light source groups 50 are registered (stored) (S1). In the present embodiment, the light source group 51 is associated with the radio wave transmission device 11, the light source group 52 is associated with the radio wave transmission device 12, and the light source group 53 is associated with the radio wave transmission device 13. Moreover, the light source group 54 is associated with the radio wave transmission device 14, the light source group 55 is associated with the radio wave transmission device 15, and the light source group 56 is associated with the radio wave transmission device 16.

Moreover, in preparation, a rule (a control rule) of illumination control executed by the lighting control device 3 is registered in the control rule storage 313 of the server 31 (S2). According to the control rule of the present embodiment, when the portable terminal 2 receives the radio wave signals emitted from the radio wave transmission devices 11 to 16, the dimming levels of the light source groups 51 to 56 are determined based on the relative relationship of reception intensities of the radio wave signals emitted from the radio wave transmission devices 11 to 16. That is, based on distances from the portable terminal 2 to the radio wave transmission devices 11 to 16, the dimming levels of the light source groups 51 to 56 are determined, thereby controlling light outputs of the light source groups 51 to 56.

Specifically, it is assumed that the dimming level can be stepwise set within a range from "1 to 10". In this case, the dimming level of the light source group 50 corresponding to the radio wave transmission device 1 corresponding to the highest reception intensity is set to "8". The dimming level of the light source group 50 corresponding to the radio wave transmission device 1 corresponding to the second largest reception intensity is set to "5". The dimming level of the light source group 50 corresponding to the radio wave transmission device 1 corresponding to the third largest reception intensity is set to "2". The light source group 50 corresponding to the radio wave transmission device 1 corresponding to the fourth highest or lower reception intensity is controlled so as to be turned off. Note that as the number corresponding to the dimming level becomes large, the light output increases, where dimming level "10" corresponds to the full lighting state.

When a user carrying the portable terminal 2 enters the control area A1, the portable terminal 2 receives the radio wave signals emitted from the radio wave transmission devices 11 to 16 (X1). The location of the portable terminal 2 in the control area A1 determines intensities (reception intensities) at which the portable terminal 2 receives the radio wave signals emitted from the radio wave transmission devices 11 to 16. That is, reception states of the radio wave signals by the portable terminal 2 change depending on the location of the portable terminal 2 in the control area A1. In general, as the distance from the portable terminal 2 to the radio wave transmission device 1 increases, the reception intensity decreases, whereas as the distance from the portable terminal 2 to the radio wave transmission device 1 decreases, the reception intensity increases.

For example, as illustrated in FIG. 1, it is assumed that the portable terminal 2 is in the vicinity of a location directly under the light source group 54. In this case, the portable terminal 2 receives the radio wave signal of the radio wave transmission device 14 which is closest to the portable terminal 2 at reception intensity "high", the radio wave signal of each of the radio wave transmission devices 13 and 15 which are second closest to the portable terminal 2 at reception intensity "intermediate", and the radio wave signal of each of the radio wave transmission devices 12 and 16 which are third closest to the portable terminal 2 at reception intensity "low". The portable terminal 2 also receives the radio wave signal of the radio wave transmission device 11 which is farthest from the portable terminal 2 at reception intensity "very low". Note that the reception intensities are categorized into "high", "intermediate", "low", and "very low" in descending order.

The portable terminal 2 transmits the reception states of the radio wave signals to the server 31 (X2). In this case, the portable terminal 2 associates the reception intensities as the reception states of the radio wave signals with the pieces of identification information of the radio wave transmission devices 11 to 16 and transmits the reception intensities to the server 31. The lighting command section 311 of the server 31 checks the reception states of the radio wave signals by the portable terminal 2 with the control rule and gives instructions on the lighting states of the light sources 5.

First, the lighting command section 311 checks the reception states of the radio wave signals by the portable terminal 2 with the circuit correspondence information and selects, as target light sources serving as control objects, (the light sources 5 of) the light source groups 50 associated with the plurality of identification information of the radio wave signals each corresponding to the reception intensity "high", "intermediate", or "low". When above-described control rule is applied, the portable terminal 2 receives the radio wave signal of each of the radio wave transmission devices 12 to 16 at the reception intensity "high", "intermediate", or "low", and therefore, the light source groups 52 to 56 are selected as target light sources.

Next, the lighting command section 311 determines the relative relationship of the reception intensities of the radio wave signals of the radio wave transmission devices 12 to 16 from the reception states of the radio wave signals by the portable terminal 2. Then, the lighting command section 311 checks the relative relationship of the reception intensities with the control rule to determine the dimming level of each of the target light sources (the light source groups 52 to 56). In this case, the dimming level of the light source group 54 is "8". The light source group 54 corresponds to the radio wave transmission device 14 of the radio wave transmission devices 12 to 16. The radio wave transmission device 14 corresponds to the highest reception intensity (the reception intensity "high"). Moreover, the dimming level of each of the light source groups 53 and 55 is "5". The light source groups 53 and 55 respectively correspond to the radio wave transmission devices 13 and 15 each corresponding to the second highest reception intensity (the reception intensity "intermediate"). Furthermore, the dimming level of each of the light source groups 52 and 56 is "2". The light source groups 52 and 56 respectively correspond to the radio wave transmission devices 12 and 16 each corresponding to the third highest reception intensity (the reception intensity "low").

The lighting command section 311 transmits to the integrated management terminal 32 the dimming signals in which the dimming levels of the light source groups 52 to 56 serving as the target light sources are set (X3). The integrated management terminal 32 relays the dimming signals to transmit the dimming signals to the subsystem 4 corresponding to the control area A1 (X4).

In the subsystem 4, the master 41 receives the dimming signals. Then, the master 41 transmits the dimming signals to the terminal apparatuses 42*a* which control the light source groups 52 to 56. Based on the dimming signals, the terminal apparatuses 42*a* turn on the light source groups 52 to 56 controlled by the terminal apparatuses 42*a* with light of the light source groups 52 to 56 being dimmed. In this case, the light source group 54 which is closest to the portable terminal 2 (a user) is lit at a dimming level of "8", the light source groups 53 and 55 which are second closest to the portable terminal 2 are lit at a dimming level of "5", and the light source groups 52 and 56 which are third closest to the portable terminal 2 are lit at a dimming level of "2".

Thus, the light source group 50 which is closest to a user carrying the portable terminal 2 has the highest illuminance, and the light source group 50 which is farther away from the user has a lower illuminance. Thus, the lighting control system 100 enables control of the control area A1 so as to provide an illumination environment comfortable for a user to work, and energy can also be saved. That is, the lighting control system 100 enables illumination control according to the location of a person present in the control area A1.

Moreover, the control rule stored in the control rule storage 313 of the server 31 may be a rule for further determining the light colors in addition to the dimming levels of the light source groups 51 to 56. That is, the light colors of the light source groups 51 to 56 are determined based on the relative relationship of the reception intensities of the radio wave signals of the radio wave transmission devices 12 to 16. Specifically, the light color of the light source group 50 corresponding to the radio wave transmission device 1 corresponding to the highest reception intensity is set to a daylight color. Moreover, the light color of each light source group 50 corresponding to the radio wave transmission device 1 corresponding to the second largest reception intensity is set to a daytime white color. Furthermore, the light color of each light source group 50 corresponding to the radio wave transmission device 1 corresponding to the third largest reception intensity is set to an incandescent color. That is, as the reception intensity decreases, the color temperature of the light color decreases.

For example, it is assumed that the portable terminal 2 receives the radio wave signal of the radio wave transmission device 14 which is closest to the portable terminal 2 at reception intensity "high", the radio wave signal of each of the radio wave transmission devices 13 and 15 which are second closest to the portable terminal 2 at reception intensity "intermediate", and the radio wave signal of each of the radio wave transmission devices 12 and 16 which are third closest to the portable terminal 2 at reception intensity "low". In this case, the light color of the light source group 54 corresponding to the radio wave transmission device 14 of the radio wave transmission devices 12 to 16 is the daylight color. The radio wave transmission device 14 corresponds to the highest reception intensity. Moreover, the light color of each of the light source groups 53 and 55 is the daylight white color. The light source groups 53 and 55 respectively correspond to the radio wave transmission devices 13 and 15 each corresponding to the second highest reception intensity. Furthermore, the light color of each of the light source groups 52 and 56 is the incandescent color. The light source groups 52 and 56 respectively correspond to the radio wave transmission devices 12 and 16 each corresponding to the third highest reception intensity.

The lighting command section 311 transmits to the integrated management terminal 32 the color-adjusting signals in which the light colors of the light source groups 52 to 56 serving as the target light sources are set (X3). The integrated management terminal 32 relays the color-adjusting signals to transmit the color-adjusting signals to the subsystem 4 corresponding to the control area A1 (X4).

In the subsystem 4, the master 41 receives the color-adjusting signals. Then, the master 41 transmits the color-adjusting signals to the terminal apparatuses 42*a* which control the light source groups 52 to 56. Based on the color-adjusting signals, the terminal apparatuses 42*a* turn on the light source groups 52 to 56 controlled by the terminal apparatuses 42*a* with the colors of light of the light source groups 52 to 56 being adjusted.

In this case, the lighting control system 100 enables color-adjusting control according to the location of a user carrying the portable terminal 2 and thus enables control for providing an illumination environment more comfortable for a user to work.

Moreover, in the lighting control system 100, performing both the dimming control and the color-adjusting control enables pattern control for causing the illumination environment in the control area A1 to be in a specific dimmed state and a specific color-adjusted state.

Moreover, the control rule may be divided and stored in the server 31 and the integrated management terminal 32. For example, the control rule to be stored in the server 31 is a rule according to which the dimming levels of the light source groups 51 to 56 are determined based on the relative relationship of the reception intensities, and the control rule to be stored in the integrated management terminal 32 is a rule according to which the color adjustment of the light source groups 51 to 56 is determined based on the relative relationship of the reception intensities.

Moreover, in the lighting control device 3, the server 31 and the integrated management terminal 32 may be realized as one computer.

Moreover, components of the lighting control device 3 may be included in the portable terminal 2, and the portable terminal 2 may directly communicate with the subsystem 4 to function as the lighting control device 3.

Second Embodiment

Figure 4:
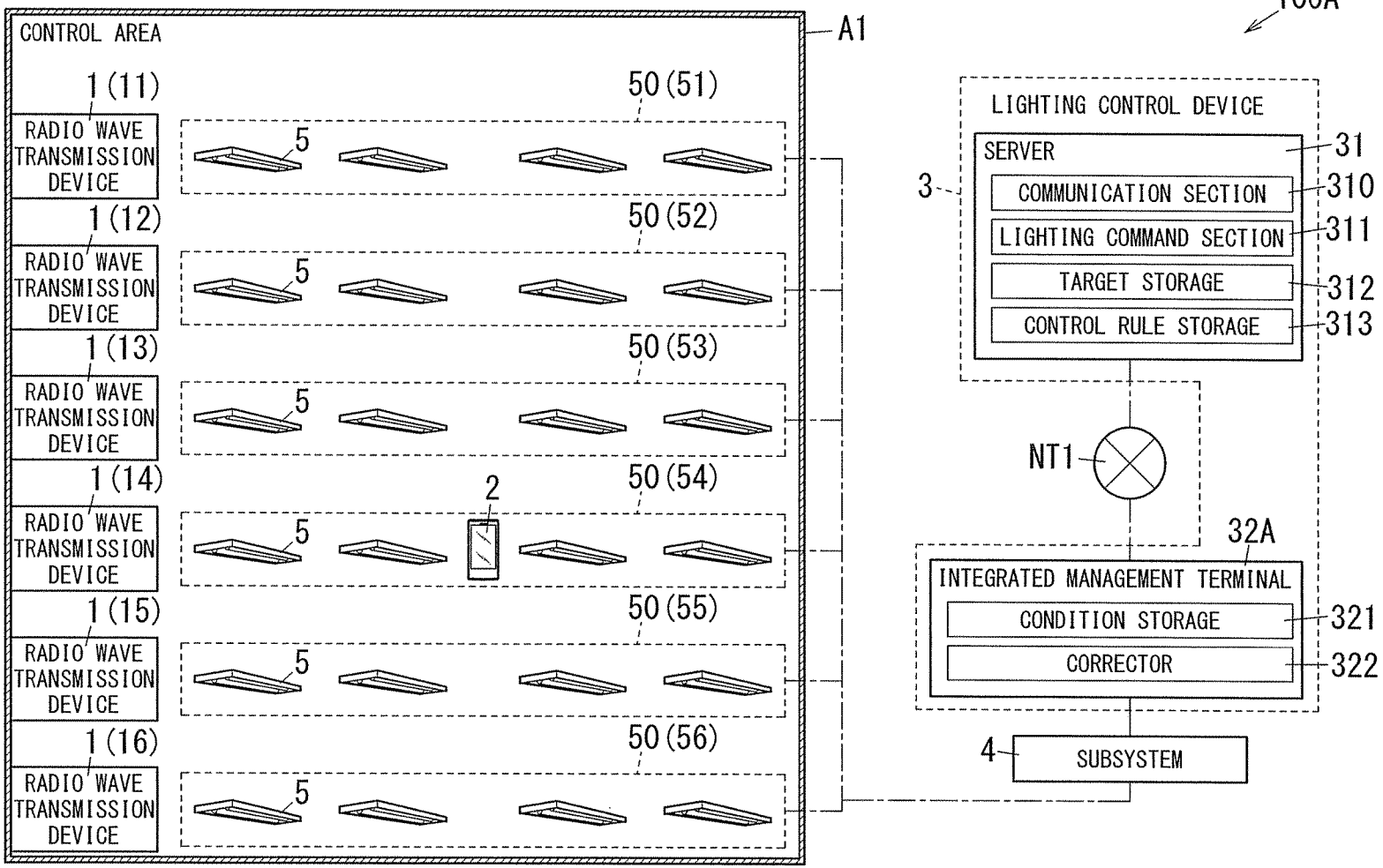
FIG. 4 is a block diagram illustrating a system configuration of a second embodiment.

As illustrated in FIG. 4, a lighting control system 100A of a second embodiment includes a lighting control device 3 having an integrated management terminal 32A. The second embodiment is different from the first embodiment in that the integrated management terminal 32A includes condition storage 321 and a corrector 322. Note that components similar to those in the first embodiment are denoted by the same reference signs as those in the first embodiment, and the description thereof is omitted.

Figure 5:
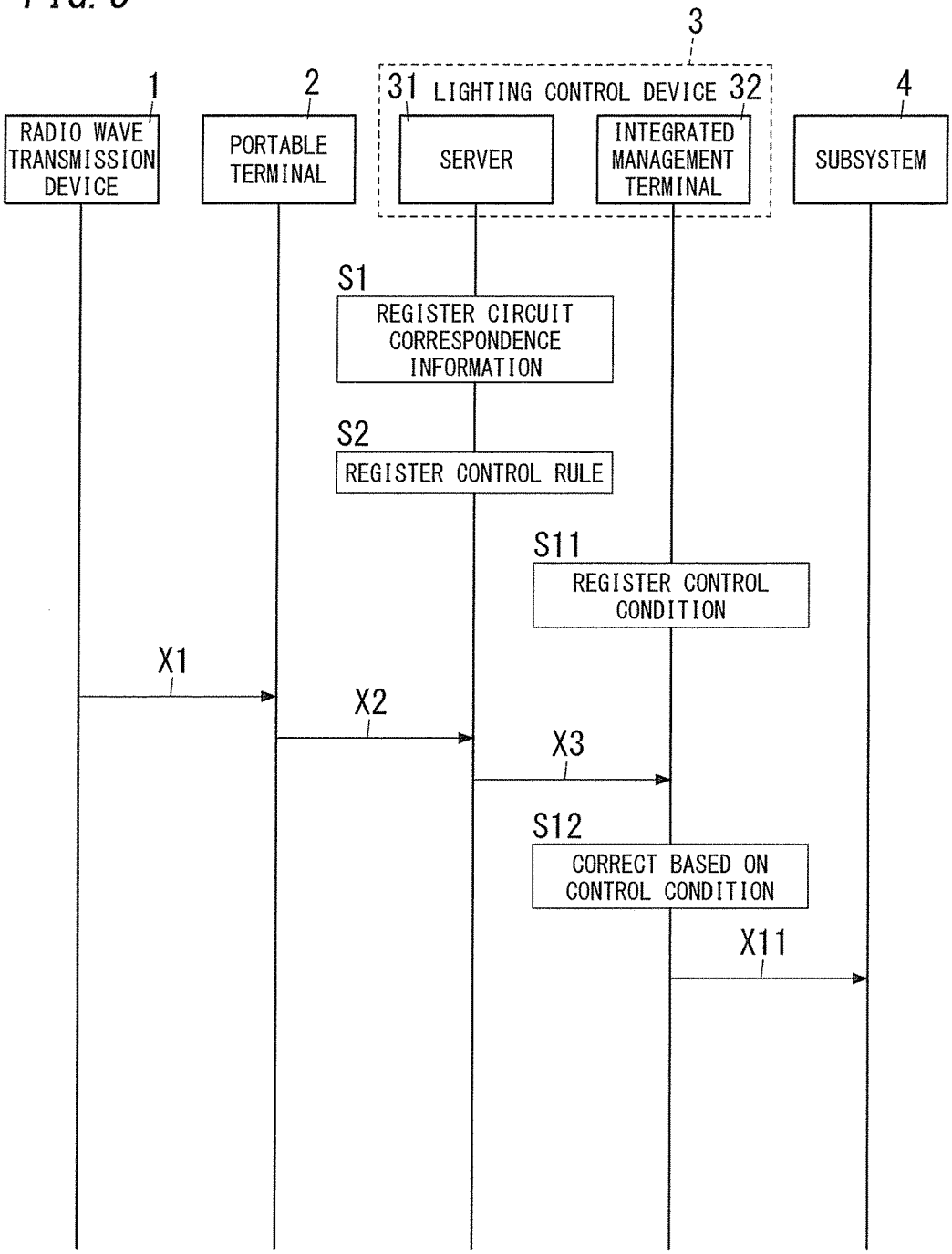
FIG. 5 is a sequence diagram illustrating operation of the second embodiment.

First, as the sequence in FIG. 5 shows, a setting condition is registered to the condition storage 321 of the integrated management terminal 32A in preparation (S11). The setting condition is a condition on the lighting state of a target light source and includes, for example, the correction amount of a dimming level, a minimum dimming level, a maximum dimming level, and a limitation on light colors.

The following description is directed to a case where the correction amount of a dimming level associated with each of a plurality of time zones is used as the setting condition.

Specifically, the correction amount of the dimming level in a time zone from 8:00 am to 6:00 pm is set to "±0", and the correction amount of the dimming level in a time zone from 6:00 pm to 8:00 am is set to "+2". These setting conditions concern an environment in which a control area A1 is irradiated with outside light during a daytime and the control area A1 is not irradiated with the outside light during a nighttime, and these setting conditions correspond to an aspect in which the control area A1 is illuminated with both the outside light and illumination light. That is, depending on the presence or absence or the intensity of the outside light, the correction amount is set for each time zone.

When a user carrying a portable terminal 2 enters the control area A1, the portable terminal 2 receives radio wave signals emitted from radio wave transmission devices 1 (X1).

For example, as illustrated in FIG. 4, it is assumed that the portable terminal 2 is in the vicinity of a location directly under a light source group 54. In this case, the portable terminal 2 receives the radio wave signal of a radio wave transmission device 14 which is closest to the portable terminal 2 at reception intensity "high", the radio wave signal of each of radio wave transmission devices 13 and 15 which are second closest to the portable terminal 2 at reception intensity "intermediate", and the radio wave signal of each of radio wave transmission devices 12 and 16 which are third closest to the portable terminal 2 at reception intensity "low". The portable terminal 2 also receives the radio wave signal of a radio wave transmission device 11 which is farthest from the portable terminal 2 at reception intensity "very low".

The portable terminal 2 transmits reception states of the radio wave signals to a server 31 (X2). Similarly to the first embodiment, a lighting command section 311 of the server 31 checks the reception states of the radio wave signals by the portable terminal 2 with a control rule to determine dimming levels of target light sources (light sources 5 of light source groups 52 to 56). In this case, the dimming level of the light source group 54 corresponding to the radio wave transmission device 14 of the radio wave transmission devices 12 to 16 is "8". The radio wave transmission device 14 corresponds to the highest reception intensity. Moreover, the dimming level of each of the light source groups 53 and 55 is "5". The light source groups 53 and 55 respectively correspond to the radio wave transmission devices 13 and 15 each corresponding to the second highest reception intensity. Furthermore, the dimming level of each of the light source groups 52 and 56 is "2". The light source groups 52 and 56 respectively correspond to the radio wave transmission devices 12 and 16 each corresponding to the third highest reception intensity.

The lighting command section 311 transmits to the integrated management terminal 32A dimming signals in which the dimming levels of the light source groups 52 to 56 serving as the target light sources are set (X3).

The corrector 322 of the integrated management terminal 32A refers to the condition storage 321 to correct the dimming levels instructed by the dimming signals received from the lighting command section 311 (S12). In the condition storage 321, a correction amount is registered for each of the time zones, and the integrated management terminal 32A corrects each of the dimming levels instructed by the dimming signals with a correction amount corresponding to the present time.

Specifically, if the present time is 12:00 pm, the correction amount is "±0", and therefore, the corrector 322 transmits to a subsystem 4 dimming signals which set the dimming level of the light source group 54 to "8", the dimming level of each of the light source groups 53 and 55 to "5", and the dimming level of each of the light source groups 52 and 56 to "2" (X11).

Alternatively, if the current time is 10:00 pm, the correction amount is "+2", and therefore, the corrector 322 transmits to the subsystem 4 dimming signals which set the dimming level of the light source group 54 to "10", the dimming level of each of the light source groups 53 and 55 to "7", and the dimming level of each of the light source groups 52 and 56 to "4" (X11).

In the subsystem 4, a master 41 receives the dimming signals from the corrector 322. Then, the master 41 transmits the dimming signals to terminal apparatuses 42*a* which control the light source groups 52 to 56. Based on the dimming signals, the terminal apparatuses 42*a* turn on the light source groups 52 to 56 controlled by the terminal apparatuses 42*a* with light of the light source groups 52 to 56 being dimmed.

In this case, light in the control area A1 is dimmed based on the dimming signals in which the dimming levels have been corrected suitably to the time zones. Thus, the lighting control system 100A enables control of the control area A1 so as to provide an illumination environment more comfortable for a user to work.

Moreover, as a variation of the present embodiment, an aspect in which specific terminal information is allocated to a portable terminal 2 in advance will be described. Terminal information is identification information allocated to each of individual portable terminals 2 in advance, and each of users carries a corresponding one of the portable terminals 2.

Thus, when the correction amount of the dimming level associated with the terminal information of each of the portable terminal 2 is adopted as a setting condition, it is possible to perform illumination control according to the attribute of a user.

Figure 6:
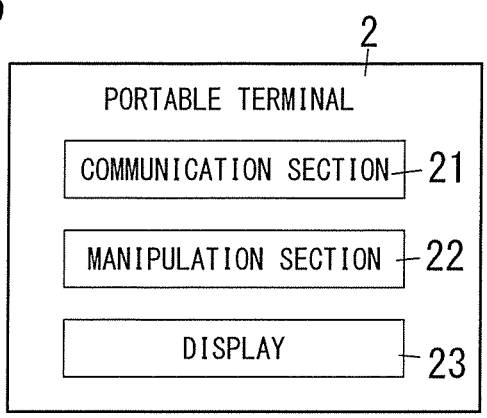
FIG. 6 is a block diagram illustrating a configuration of a portable terminal of the second embodiment.

As illustrated in FIG. 6, the portable terminal 2 includes a communication section 21, an manipulation section 22, and a display 23. The communication section 21 functions as a communication interface which is to be connected to a wide-area communication network NT1 via an access point or a mobile communication network and which communicates with a communication device on the wide-area communication network NT1. The manipulation section 22 includes a manipulation button, a touch panel, or the like, and receives manipulation given by a user. The display 23 displays a manipulation screen of an application, image data acquired via the communication section 21, and the like.

The portable terminal 2 is configured to transmit a setting condition including terminal information of the portable terminal 2 to the integrated management terminal 32A when a user manipulates the manipulation section 22. In the integrated management terminal 32A, the received setting condition is associated with the received terminal information, and then the setting condition is stored in the condition storage 321. That is, a user can create a setting condition by oneself and store the setting condition in the condition storage 321. For example, as the setting condition, correction amount "±0" is registered in terminal information of a portable terminal 2 carried by a male, and correction amount "+2" is registered in terminal information of a portable terminal 2 carried by a female.

When a user carrying the portable terminal 2 enters the control area A1, the portable terminal 2 transmits the reception state of a radio wave signal to the server 31. At this time, the portable terminal 2 adds terminal information of the portable terminal 2 to the reception state of the radio wave signal and then transmits the reception state.

Similarly to the first embodiment, the lighting command section 311 of the server 31 transmits to the integrated management terminal 32A dimming signals in which the dimming levels of the light source groups 52 to 56 serving as target light sources are set (X3). At this time, the dimming signals transmitted by the lighting command section 311 include the terminal information of the portable terminal 2.

The corrector 322 of the integrated management terminal 32A refers to the condition storage 321 to correct the dimming levels instructed by the dimming signals received from the lighting command section 311 (S12). In the condition storage 321, a correction amount for each of the pieces of terminal information is registered, and the integrated management terminal 32A corrects dimming levels instructed by the dimming signals by a correction amount corresponding to the terminal information of the portable terminal 2.

Specifically, in the case of a portable terminal 2 carried by a male, the correction amount is "±0", and thus, the corrector 322 transmits to the subsystem 4 dimming signals for setting the dimming level of the light source group 54 to "8", the dimming level of each of the light source groups 53 and 55 to "5", and the dimming level of each of the light source groups 52 and 56 to "2" (X11).

Alternatively, in the case of a portable terminal 2 carried by a female, the correction amount is "+2", and thus, the corrector 322 transmits to the subsystem 4 dimming signals for setting the dimming level of the light source group 54 to "10", the dimming level of each of the light source groups 53 and 55 to "7", and the dimming level of each of the light source groups 52 and 56 to "4" (X11).

In the subsystem 4, a master 41 receives the dimming signals from the corrector 322. Then, the master 41 transmits the dimming signals to the terminal apparatuses 42*a* which control the light source groups 52 to 56. Based on the dimming signals, the terminal apparatuses 42*a* turn on the light source groups 52 to 56 controlled by the terminal apparatuses 42*a* with light of the light source groups 52 to 56 being dimmed.

In this case, light in the control area A1 is dimmed on the basis of a dimming signal corrected to a dimming level suitable for each user. Thus, the lighting control system 100A enables control of the control area A1 so as to provide an illumination environment more comfortable for a user to work.

Third Embodiment

Figure 7:
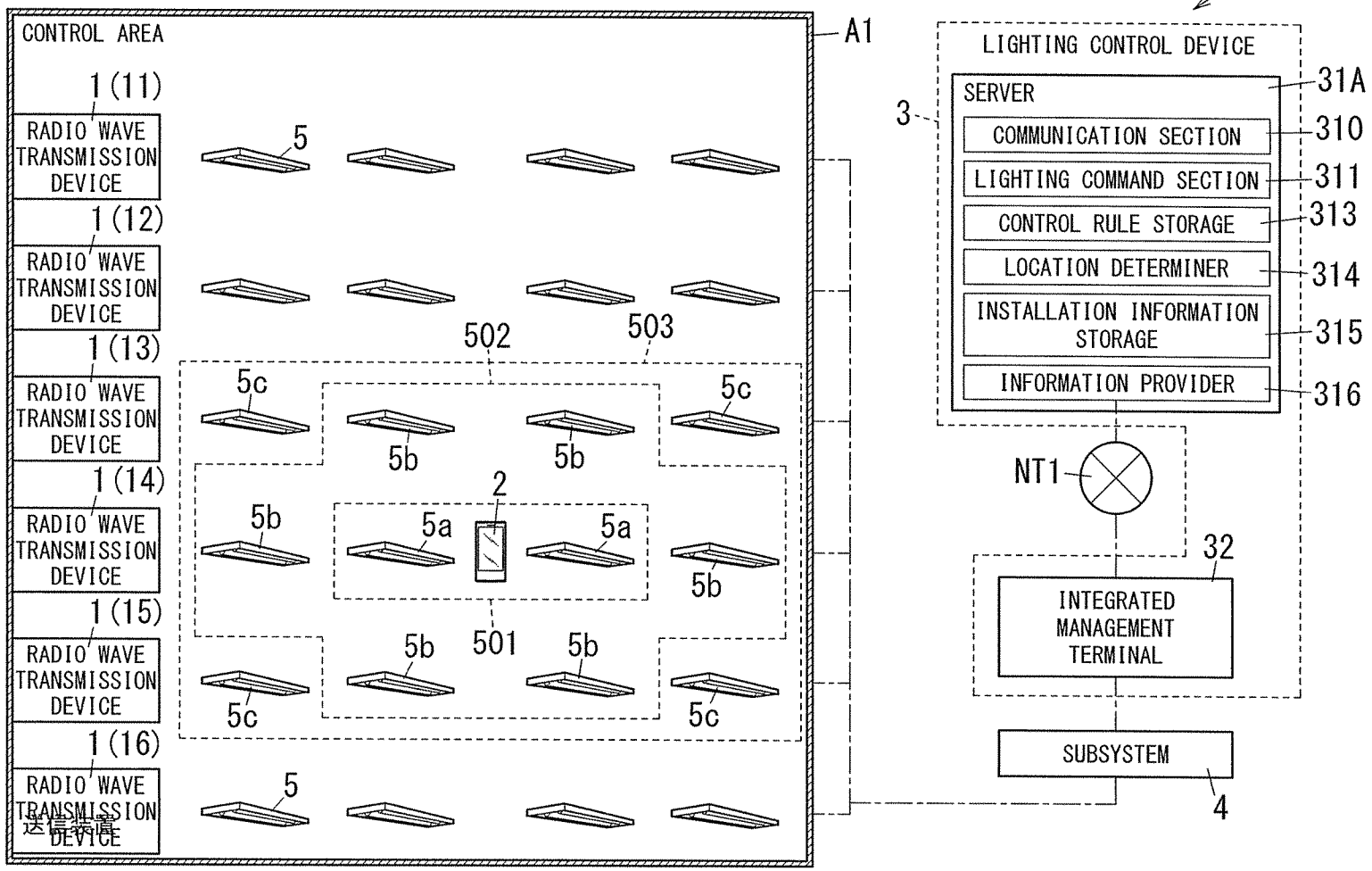
FIG. 7 is a block diagram illustrating a system configuration of a third embodiment.

As illustrated in FIG. 7, a lighting control system 100B of a third embodiment includes a lighting control device 3 having a server 31A. The server 31A includes a communication section 310, a lighting command section 311, and control rule storage 313. The third embodiment is different from the first embodiment in that the server 31A further includes a location determiner 314, installation information storage 315, and an information provider 316. Note that components similar to those in the first embodiment are denoted by the same reference signs as those in the first embodiment, and the description thereof is omitted.

The installation information storage 315 stores installation information in advance. The installation information associates identification information of each of radio wave transmission devices 1 with a location of the radio wave transmission device 1 including the identification information. The installation information is information regarding an installation place and showing each of locations to which the radio wave transmission devices 1 corresponding to the pieces of identification information correspond in a control area A1.

The location determiner 314 refers to the installation information in the installation information storage 315, and based on reception states of radio wave signals in a portable terminal 2, the location determiner 314 determines the location (the location of a user) of the portable terminal 2. Specifically, the location determiner 314 obtains distances from the portable terminal 2 to radio wave transmission devices 11 to 16 on the basis of reception intensities of the radio wave signals of the radio wave transmission devices 11 to 16. The location determiner 314 refers to the installation information of the installation information storage 315 to determine (detect) the location of the portable terminal 2 in the control area A1 from the distances from the portable terminal 2 to the radio wave transmission devices 11 to 16.

In the control rule storage 313, a rule (a control rule) of illumination control to be executed by a lighting control device 3 is registered in advance. According to the control rule of the present embodiment, based on the location of the portable terminal 2 in the control area A1, a light source 5 close to the portable terminal 2 is set to a high dimming level, and a light source 5 away from the portable terminal 2 is set to a low dimming level with the location of the portable terminal 2 being defined as the center.

The lighting command section 311 selects light sources 5*a* closest to the portable terminal 2, light sources 5*b* second closest to the portable terminal 2, and light sources 5*c* third closest to the portable terminal 2 serving as target light sources of control objects with the location of the portable terminal 2 being defined as the center. Note that in FIG. 5, a group of the light sources 5*a* is denoted as a light source group 501, a group of the light sources 5*b* is denoted as a light source group 502, and a group of the light sources 5*c* is denoted as a light source group 503.

Based on the control rule, the lighting command section 311 sets dimming levels for the light sources 5*a*, 5*b*, and 5*c* serving as the target light sources. For example, as illustrated in FIG. 7, the dimming level of each of the light sources 5*a* closest to the portable terminal 2 is "8", the dimming level of each of the light sources 5*b* second closest to the portable terminal 2 is "5", and the dimming level of each of the light sources 5*c* third closest to the portable terminal 2 is "2".

The lighting command section 311 transmits to an integrated management terminal 32 dimming signals in which the dimming levels of the light sources 5*a* to 5*c* serving as the target light sources are set. The integrated management terminal 32 relays the dimming signals to transmit the dimming signals to a subsystem 4.

In the subsystem 4, a master 41 receives the dimming signals. The master 41 transmits the dimming signals to terminal apparatuses 42*a* which control the light sources 5*a* to 5*c*. Based on the dimming signals, the terminal apparatuses 42*a* turn on the light sources 5*a* to 5*c* controlled by the terminal apparatuses 42*a* with light of the light sources 5*a* to 5*c* being dimmed.

Thus, the location of a user carrying the portable terminal 2 has the highest illuminance, and as the distance from the user increases, the illuminance concentrically decreases. Thus, an illumination environment can be controlled so as to be comfortable for a user to work, and energy can also be saved. That is, the lighting control system 100 enables illumination control according to the location of a person present in the control area A1.

Moreover, similarly to the first embodiment, also in the lighting control system 100B, performing both the dimming control and the color-adjusting control enables pattern control for causing the illumination environment in the control area A1 to be in a specific dimmed state and a specific color-adjusted state.

For example, when the control area A1 is a warehouse or a factory, a worker carries the portable terminal 2. In this case, the worker is present in the location of the portable terminal 2, and therefore, a control rule is registered such that pattern control resulting in illumination according to work steps performed in the location of the portable terminal 2 is executed.

Alternatively, if the control area A1 is a shop, a customer carries the portable terminal 2. In this case, the customer is present in the location of the portable terminal 2, and therefore, a control rule is registered such that pattern control resulting in illumination according to products displayed in the location of the portable terminal 2 is executed.

Moreover, the information provider 316 assumes that a user is present in the location of the portable terminal 2 in the control area A1, and the information provider 316 transmits provision information according to the location of the user to the portable terminal 2. If a user is a worker in a factory, a warehouse, or the like, the provision information is information regarding work processes performed in the location of the user (maintenance information regarding used tools, information regarding work procedures, etc.). Alternatively, if a user is a customer in a shop, the provision information is information regarding products displayed in the location of the user (product names, details of the products, etc.).

Thus, the lighting control system 100B can provide information according to the location of a person present in the control area A1 in addition to illumination control according to the location of the person present in the predetermined area, so that convenience is improved.

As described above, a lighting control system 100 of a first aspect according to the embodiment includes a plurality of light sources 5 installed in a predetermined area (a control area A1), at least one radio wave transmission device 1, a portable terminal 2, and a lighting control device 3. The at least one radio wave transmission device 1 is configured to emit a radio wave signal in the predetermined area. The portable terminal 2 is configured to receive the radio wave signal emitted from the at least one radio wave transmission device 1 and is portable by a user. The lighting control device 3 is configured to select, based on an intensity of the radio wave signal received by the portable terminal 2 from the at least one radio wave transmission device 1, a target light source serving as a light source of a control object from the plurality of light sources 5 and to control a lighting state of the target light source.

Thus, the lighting control system 100 enables illumination control according to the location of a person present in the predetermined area. Moreover, even when there are goods, obstacles, and the like in the predetermined area, the portable terminal 2 can receive the radio wave signals from the at least one radio wave transmission device 1, which improves the user-friendliness of the lighting control system 100.

In a lighting control system 100 of a second aspect according to the embodiment referring to the first aspect, the lighting control device 3 is preferably configured to control a light output of the target light source.

In this case, the lighting control system 100 enables control of an illumination environment so as to provide an appropriate illumination environment by dimming control, and energy can also be saved.

In a lighting control system 100 of a third aspect according to the embodiment referring to the first or second aspect, the lighting control device 3 is preferably configured to control a color of light emitted from the target light source.

In this case, the lighting control system 100 enables control of an illumination environment so as to provide an appropriate illumination environment by adjusting the color of light in the illumination environment.

In a lighting control system 100 of a fourth aspect according to the embodiment referring to any one of the first to third aspects, the at least one radio wave transmission device 1 preferably includes a plurality of radio wave transmission devices 1 (11 to 16). In this case, the plurality of radio wave transmission devices 1 are configured to emit, in the predetermined area, the radio wave signals each of which includes a piece of identification information specific to a corresponding one of the plurality of radio wave transmission devices 1. The lighting control device 3 is configured to select the target light source based on intensities and pieces of identification information of the radio wave signals received by the portable terminal 2 from the plurality of radio wave transmission devices 1 and to control the lighting state of the target light source.

Thus, using the plurality of radio wave transmission devices 1 enables more accurate determination of the location of the portable terminal 2, and therefore, the lighting control system 100 enables more accurate illumination control according to the location of a person present in the predetermined area.

Moreover, a lighting control system 100 of a fifth aspect according to the embodiment referring to the fourth aspect preferably further includes target storage 312 in which each of the pieces of identification information is associated with at least one of the plurality of light sources 5. The lighting control device 3 is configured to select, as the target light source, at least one light source 5 corresponding to a piece of the identification information of the radio wave signal received by the portable terminal 2 from each of the plurality of radio wave transmission devices 1. The lighting control device 3 is configured to control the lighting state of the target light source based on a relative relationship of the intensities of the radio wave signals received from the plurality of radio wave transmission devices 1.

Thus, the lighting control device 3 can determine the location of the portable terminal 2 based on the distances from the portable terminal 2 to each of the plurality of radio wave transmission devices 1 and can control the lighting state of the target light source.

Moreover, a lighting control system 100B of a sixth aspect according to the embodiment referring to the fourth aspect preferably further includes a location determiner 314. The location determiner 314 is configured to refer to a correspondence relationship between each of the pieces of identification information and a location of a corresponding one of the plurality of radio wave transmission devices 1 which includes the identification information to determine the location of the portable terminal 2 in the predetermined area based on the intensities of the radio wave signals received by the portable terminal 2 from the plurality of radio wave transmission devices 1. The lighting control device 3 is configured to select the target light source based on the location of the portable terminal 2 and to control the lighting state of the target light source.

Thus, the location of a person present in the predetermined area is more accurately detected, and therefore, the lighting control system 100B enables more appropriate illumination control according to the location of a person present in the predetermined area.

A lighting control system 100A of a seventh aspect according to the embodiment referring to any one of the first to sixth aspects preferably further includes condition storage 321 in which at least one setting condition is stored. The at least one setting condition is a condition on the lighting state of the target light source. The lighting control device 3 preferably further includes a corrector 322 configured to correct, in accordance with the at least one setting condition, the lighting state of the target light source determined based on the intensity of the radio wave signal.

In this case, it is possible to set the lighting state of the target light source not only based on the location of a person in the predetermined area but also based on the setting condition. Therefore, the illumination environment can be more appropriately controlled.

In a lighting control system 100A of an eighth aspect according to the embodiment referring to the seventh aspect, the at least one setting condition preferably includes a plurality of setting conditions. In the condition storage 321, each of the plurality of setting conditions is preferably associated with a corresponding one of a plurality of time zones. The corrector 322 preferably corrects the lighting condition of the target light source based on one of the plurality of setting conditions which corresponds to a time zone including a present time.

In this case, it is possible to set the lighting state of the target light source not only based on the location of a person in the predetermined area but also based on the time zones. Therefore, the illumination environment can be controlled more finely based on each time zone.

In a lighting control system 100A of a ninth aspect according to the embodiment referring to the seventh or eighth aspect, the portable terminal 2 includes terminal information which is specific to the portable terminal 2. In the condition storage 321, the setting condition is associated with the terminal information. The portable terminal 2 includes an manipulation section 22 configured to receive manipulation given by a user so as to cause the condition storage 321 to store the setting condition corresponding to the terminal information of the portable terminal 2. The corrector 322 corrects the lighting condition of the target light source based on the setting condition corresponding to the terminal information of the portable terminal 2 which receives the radio wave signal from the at least one radio wave transmission device 1.

In this case, it is possible to set the lighting state of the target light source not only based on the location of a person in the predetermined area but also based on users. Therefore, the illumination environment can be controlled more finely based on each of the users.

A lighting control device 3 of a tenth aspect according to the embodiment is used for the lighting control system 100, 100A, or 100B. The lighting control system 100, 100A, or 100B includes a plurality of light sources 5 installed in a predetermined area (a control area A1), at least one radio wave transmission device 1, and a portable terminal 2. The at least one radio wave transmission device 1 emits a radio wave signal in the predetermined area. The portable terminal 2 is configured to receive the radio wave signal emitted from the radio wave transmission device 1 and is portable by a user. The lighting control device 3 includes a communication section 310 configured to communicate with the portable terminal 2 and a lighting command section 311. The lighting command section 311 is configured to select a target light source serving as a light source of a control object from the plurality of light sources 5 based on an intensity of the radio wave signal received by the portable terminal 2 from the at least one radio wave transmission device 1 and to control a lighting state of the target light source.

Thus, lighting control device 3 enables illumination control according to the location of a person present in the predetermined area.

Note that the above-described embodiments are mere examples of the present invention. Thus, the present invention is not limited to the above-described embodiments. Even in embodiments other than these embodiments, various modifications may be made depending on design and the like without departing from the technical idea of the present invention.

Reference Signs List

| | |
|---|---|
| 100, 100A, 100B | Lighting Control System |
| A1 | Control Area |
| 1 (11, 12, . . . ) | Radio Wave Transmission Device |
| 2 | Portable Terminal |
| 22 | Manipulation section |
| 3 | Lighting Control Device |
| 31, 31A | Server |
| 310 | Communication Section |
| 311 | Lighting Command Section |
| 312 | Target Storage |
| 313 | Control Rule Storage |
| 314 | Location Determiner |
| 315 | Installation Information Storage |
| 316 | Information Provider |
| 32, 32A | Integrated Management Terminal |
| 321 | Condition Storage |
| 322 | Corrector |
| 4 | Subsystem |
| 5 | Light Source |

The invention claimed is:

1. A lighting control system, comprising:

a plurality of light sources installed in a predetermined area;

at least one radio wave transmission device configured to emit a radio wave signal in the predetermined area;

a portable terminal configured to receive the radio wave signal emitted from the at least one radio wave transmission device, the portable terminal being portable by a user; and a lighting control device configured to select, based on an intensity of the radio wave signal received by the portable terminal from the at least one radio wave transmission device, a target light source serving as a light source of a control object from the plurality of light sources and to control a lighting state of the target light source, wherein the plurality of light sources and the at least one radio wave transmission device are separate from each other, the at least one radio wave transmission device includes a plurality of radio wave transmission devices, the plurality of radio wave transmission devices are configured to emit, in the predetermined area, the radio wave signals each of which includes a piece of identification information specific to a corresponding one of the plurality of radio wave transmission devices, and the lighting control device is configured to select the target light source based on intensities and pieces of identification information of the radio wave signals received by the portable terminal from the plurality of radio wave transmission devices and to control the lighting state of the target light source, wherein the lighting control system further comprises:

a location determiner configured to refer to a correspondence relationship between each of the pieces of identification information and a location of a corresponding one of the plurality of radio wave transmission devices which includes the identification information to determine a location of the portable terminal in the predetermined area based on the intensities of the radio wave signals received by the portable terminal from the plurality of radio wave transmission devices, wherein the lighting control device is configured:

to select the target light source based on the location of the portable terminal, and to control the lighting state of the target light source.

2. A lighting control system, comprising:

a plurality of light sources installed in a predetermined area;

at least one radio wave transmission device configured to emit a radio wave signal in the predetermined area;

a portable terminal configured to receive the radio wave signal emitted from the at least one radio wave transmission device, the portable terminal being portable by a user;

a lighting control device configured to select, based on an intensity of the radio wave signal received by the portable terminal from the at least one radio wave transmission device, a target light source serving as a light source of a control object from the plurality of light sources and to control a lighting state of the target light source; and condition storage in which at least one setting condition is stored, the at least one setting condition being a condition on the lighting state of the target light source, wherein the lighting control device further includes a corrector configured to correct, in accordance with the at least one setting condition, the lighting state of the target light source determined based on the intensity of the radio wave signal.

3. The lighting control system according to claim 1, wherein the at least one setting condition includes a plurality of setting conditions, in the condition storage, each of the plurality of setting conditions is associated with a corresponding one of a plurality of time zones, and the corrector corrects the lighting condition of the target light source based on one of the plurality of setting conditions which corresponds to a time zone including a present time.

4. The lighting control system according to claim 1, wherein the portable terminal includes terminal information which is specific to the portable terminal, in the condition storage, the setting condition is associated with the terminal information, the portable terminal includes an manipulation section configured to receive manipulation given by a user so as to cause the condition storage to store the setting condition corresponding to the terminal information of the portable terminal, and the corrector corrects the lighting condition of the target light source based on the setting condition corresponding to the terminal information of the portable terminal which receives the radio wave signal from the at least one radio wave transmission device.

5. A lighting control device for a lighting control system comprising: a plurality of light sources installed in a predetermined area; a plurality of radio wave transmission devices configured to emit radio wave signals in the predetermined area; a portable terminal configured to receive the radio wave signals emitted from the plurality of radio wave transmission devices, the portable terminal being portable by a user and a location determiner, and the plurality of light sources and the plurality of radio wave transmission devices are separate from each other, the plurality of radio wave transmission devices are configured to emit, in the predetermined area, the radio wave signals each of which includes a piece of identification information specific to a corresponding one of the plurality of radio wave transmission devices, the location determiner refer to a correspondence relationship between each of the pieces of identification information and a location of a corresponding one of the plurality of radio wave transmission devices which includes the identification information to determine a location of the portable terminal in the predetermined area based on the intensities of the radio wave signals received by the portable terminal from the plurality of radio wave transmission devices, the lighting control device comprising:

a communication section configured to communicate with the portable terminal; and a lighting command section configured to select a target light source serving as a light source of a control object from the plurality of light sources based on the location of the portable terminal and to control a lighting state of the target light source.

* * * * *